US006540324B2

(12) United States Patent
Medin

(10) Patent No.: US 6,540,324 B2
(45) Date of Patent: Apr. 1, 2003

(54) CONTOURED CROSS-SECTIONAL WIPER FOR CLEANING INKJET PRINTHEADS

(75) Inventor: Todd R. Medin, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 133 days.

(21) Appl. No.: 09/726,671

(22) Filed: Nov. 29, 2000

(65) Prior Publication Data

US 2001/0000434 A1 Apr. 26, 2001

Related U.S. Application Data

(60) Provisional application No. 09/404,919, filed on Sep. 24, 1999, now Pat. No. 6,193,357.

(51) Int. Cl.[7] ..... B41J 2/165
(52) U.S. Cl. ..... 347/33
(58) Field of Search ..... 347/22, 33, 32; 15/250.361

(56) References Cited

U.S. PATENT DOCUMENTS

| | | | | |
|---|---|---|---|---|
| 5,103,244 | A | 4/1992 | Gast et al. | 347/33 |
| 5,115,250 | A | 5/1992 | Harmon et al. | 347/33 |
| 5,151,715 | A | 9/1992 | Ward et al. | 347/33 |
| 5,500,660 | A | 3/1996 | Childers et al. | 347/33 |
| 5,602,573 | A | 2/1997 | Waschhauser et al. | 347/33 |
| 5,614,930 | A | 3/1997 | Osborne et al. | 347/33 |
| 5,621,441 | A | 4/1997 | Waschhauser et al. | 347/33 |
| 5,644,347 | A | 7/1997 | Schwiebert et al. | 347/33 |
| 5,745,133 | A | 4/1998 | Hendricks et al. | 347/33 |
| 5,815,176 | A | 9/1998 | Rotering | 347/33 |
| 5,949,448 | A | 9/1999 | Man et al. | 347/33 |
| 5,980,018 | A | 11/1999 | Taylor et al. | 347/31 |
| 5,997,128 | A | 12/1999 | Lou et al. | 347/33 |
| 6,193,357 | B1 * | 2/2001 | Medin | 347/33 |
| 6,244,685 | B1 * | 6/2001 | Yamada et al. | 347/33 |

* cited by examiner

*Primary Examiner*—Shih-Wen Hsieh

(57) ABSTRACT

An inkjet printhead service station for an inkjet printing mechanism includes a printhead wiping system having a wiper blade with a contoured cross sectional shape selected to impart a lower wiping force along an ink-ejecting nozzle region of the printhead than along side regions of the printhead. In a relaxed state, the blade has opposing leading and trailing surfaces, with each surface having a concave contour running along at least a portion of the length of the blade, preferably from the support sled to the wiping tip. During a wiping stroke, the blade flexes along both the length and width of the blade, with the trailing surface having a greater degree of concavity than when relaxed, and the leading surface having a linear contour at the wiping tip and tapering into the concave contour adjacent the sled. An inkjet printing mechanism having such a wiping system, and a method of cleaning a printhead are provided.

18 Claims, 5 Drawing Sheets

FIG. 3
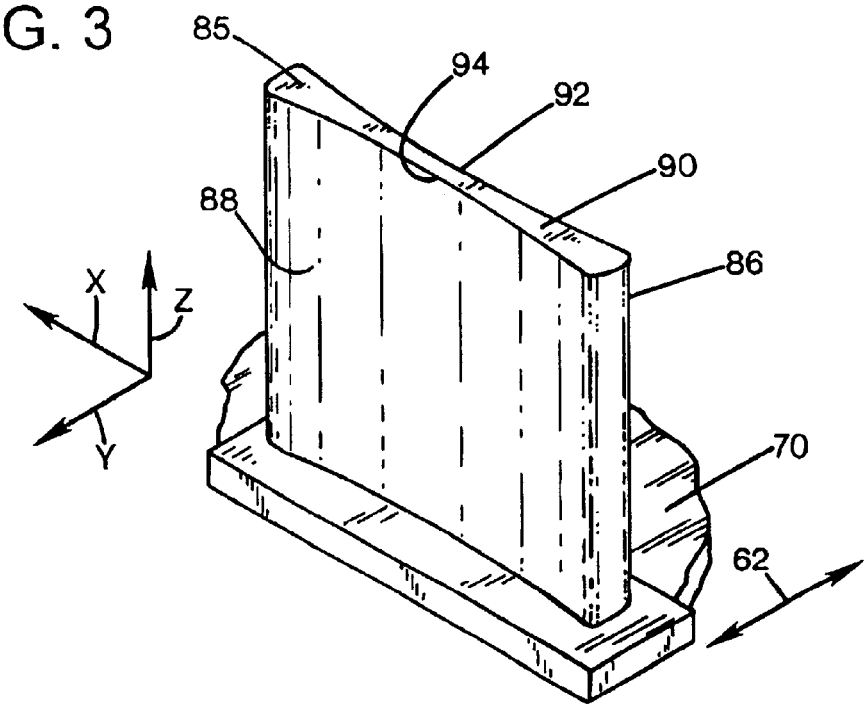
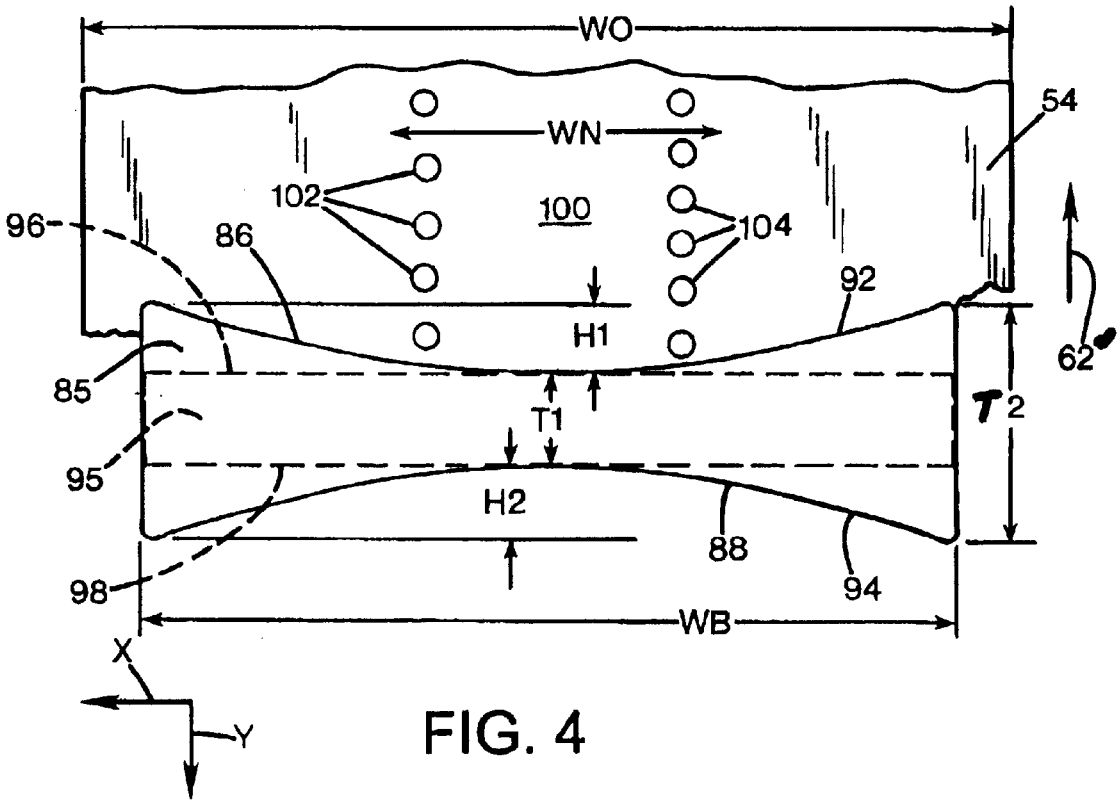
FIG. 4

CONTOURED CROSS-SECTIONAL WIPER FOR CLEANING INKJET PRINTHEADS

CROSS REFERENCE TO RELATED APPLICATION(S)

This is a continuation of application Ser. No. 09/404,919 filed on Sep. 24, 1999, now U.S. Pat. No. 6,193,357 issued on Feb. 27, 2001.

FIELD OF THE INVENTION

The present invention relates generally to inkjet printing mechanisms, and more particularly to a wiper blade for wiping ink residue from inkjet printheads, with the wiper blade having a contoured, non-rectangular, cross sectional shape selected to lower the blade wiping force along a nozzle area of the printhead.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. To facilitate priming, some printers have priming caps that are connected to a pumping unit to draw a vacuum on the printhead. During operation, partial occlusions or clogs in the printhead are periodically cleared by firing a number of drops of ink through each of the nozzles in a clearing or purging process known as "spitting." The waste ink is collected at a spitting reservoir portion of the service station, known as a "spittoon." After spitting, uncapping, or occasionally during printing, most service stations have a flexible wiper, or a more rigid spring-loaded wiper, that wipes the printhead surface to remove ink residue, as well as any paper dust or other debris that has collected on the printhead.

To improve the clarity and contrast of the printed image, recent research has focused on improving the ink itself. To provide quicker, more waterfast printing with darker blacks and more vivid colors, pigment based inks have been developed. These pigment based inks have a higher solids content than the earlier dye-based inks, which results in a higher optical density for the new inks. Both types of ink dry quickly, which allows inkjet printing mechanisms to use plain paper. Unfortunately, the combination of small nozzles and quick-drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, keeping the nozzle face plate clean becomes even more important when using pigment based inks, because they tend to accumulate more debris than the earlier dye based inks.

Indeed, keeping the nozzle face plate clean for cartridges using pigment based inks has proven quite challenging. These pigment based inks require a higher wiping force than that previously needed for dye based inks. Yet, there is an upper limit to the wiping force because excessive forces may damage the orifice plate, particularly around the nozzle openings. Thus, a delicate balance is required in wiper design to adequately clean the orifice plate to maintain print quality, while avoiding damage to the nozzle plate itself.

Many previous wiping solutions used a cantilever wiping approach. In cantilever wiping, a flexible, low durometer elastomeric blade is supported at its base by a sled. While the sled may be stationary, in many designs it was moveable so the sled could travel to a position where the wipers engage the nozzle plate. Wiping was accomplished through relative motion of the wipers with respect to the nozzle plate, by either moving the wiper relative to a stationary nozzle plate, or by moving the nozzle plate relative to a stationary wiper. The earlier wiper positioning mechanisms included sled and ramp systems, rack and pinion gear systems, and rotary systems.

The flexibility of the cantilever wiper accommodates for variations in the distance between the nozzle plate and sled, also referred to as variations in the "interference" between the wiper and nozzle plate. That is, for a closer sled-to-nozzle spacing (or a "greater interference"), the wiper flexed more than it would for a larger spacing. The force transmitted to the face plate was determined by the degree of bending of the wiper blade, as well as by the stiffness of the wiper blade material. The stiffness of the wiper blade is a function of the geometry of the blade and of the material selected. For instance, one common measure of elastomeric flexibility (tested using a sample of a standard size) is known as the "durometer," including a variety of scales known to those skilled in the art, such as the Shore A durometer scale.

Besides focusing on the material selection for inkjet wipers, other research has investigated changing the contour of the profile of the wiper tip which contacts the printhead orifice plate. A revolutionary rotary, orthogonal wiping scheme was first used in the Hewlett-Packard Company's DeskJet® 850C color inkjet printer, where the wipers ran along the length of the linear arrays, wicking ink from one nozzle to the next to act as a solvent to break down ink residue accumulated on the nozzle plate. This product used a dual wiper blade system, with the wiper blades each having an outboard rounded edge and an inboard angular wiping edge. The rounded edges encountered the nozzles first and formed a capillary channel between the blade and the orifice plate to wick ink from the nozzles as the wipers moved orthogonally along the length of the nozzle arrays. The wicked ink was pulled by the rounded edge of the leading wiper blade to the next nozzle in the array, where it acts as a solvent to dissolve dried ink residue accumulated on the printhead face plate. The angular edge of the trailing wiper blade then scraped the dissolved residue from the orifice plate. The black ink wiper had notches cut in the tip which served as escape passageways for balled-up ink residue to be moved away from the nozzle arrays during the wiping stroke. One example of this system is described in greater detail in U.S. Pat. No. 5,614,930, assigned to the Hewlett-Packard Company. While the wiper tip had a rounded wiping edge and an opposing angular wiping edge, the remainder of the blade had a uniform rectangular cross sectional shape.

Another wiping system using a spring-loaded, non-bending upright wiper was first sold in the Hewlett-Packard Company's DeskJet® 660C color inkjet printer. Through a rocking action of the wiper blade and compression of the spring, manufacturing tolerance variations were accommodate for, including component variations in the service station, the printhead carriage, and in the pens themselves. Selection of the spring determined the perpendicular wiping force applied to the orifice plate. The wiper tip in this system had a triangular profile, with the remainder of the blade having uniform rectangular cross sectional shape. One example of this system is described in greater detail in U.S. Pat. No. 5,745,133, assigned to the Hewlett-Packard Company.

The wiping of a pen orifice plate or face has long been used to keep the face clean from crusted ink and other debris. However, over time it has been found that applying excessive forces perpendicular to the pen face may cause damage to the nozzle openings or orifices used to eject the ink from the printhead. FIG. 10 is a graph of the relatively constant level of perpendicular force, FP(X), applied across the entire width X of a printhead orifice plate WO when wiping with a prior art wiper blade having a rectangular cross sectional shape, with the force experienced by nozzle orifice openings being indicated at WN.

One set of solutions to this problem investigated changing the geometry of the wiper blade to lower this perpendicular wiping force. The two primary approaches investigated were (1) lengthening of the wiper blade to make it project further from its support toward the printhead, and (2) making the wiper blade thinner in the wiping direction. Unfortunately, both of these proposed geometric changes to the wiper blade were expected to result in a wiper which is more difficult to mold because the mold cavity would be either deeper or thinner, making it difficult to fill and resulting in higher scrap out rates from blades which have corners missing or voids formed therein.

Thus, the need exists for an improved wiper blade which adequately cleans crusted ink and other debris from an inkjet printhead, without applying excessive perpendicular force to the printhead in the area of the ink ejecting nozzle orifices.

SUMMARY OF THE INVENTION

According to one aspect of the present invention, a wiping system is provided for cleaning an inkjet printhead of an inkjet printing mechanism. The wiping system includes a wiping system for cleaning an inkjet printhead of an inkjet printing mechanism having a chassis, with the printhead having a first region and a second region. The wiping system includes a sled supported by the chassis, and a wiper blade. The wiper blade is supported by the sled to engage and wipe the printhead through relative motion of the blade and the printhead in a wiping direction. The wiper blade has a cross sectional shape selected to impart a first wiping force on the first region of the printhead and a second wiping force different from the first wiping force on the second region of the printhead.

According to another aspect of the present invention, a wiping system is provided for cleaning an inkjet printhead of an inkjet printing mechanism having a chassis. The wiping system includes a sled supported by the chassis, and a wiper blade. The wiper blade is supported by the sled to engage and wipe the printhead through relative motion of the blade and the printhead in a wiping direction. The wiper blade has a leading surface, which encounters the printhead when wiping in the wiping direction, and a trailing surface opposing the leading surface. The leading surface has a width with a first contour when relaxed, and a second contour different from the first contour when wiping the printhead.

According to another aspect of the present invention, a wiping system is provided for cleaning an inkjet printhead of an inkjet printing mechanism having a chassis. The wiping system includes a sled supported by the chassis. The wiping system also has a wiper blade supported by the sled to engage and wipe the printhead through relative motion of the blade and the printhead in a wiping direction. The wiper blade has a width and a length, with the blade having a first shape when relaxed and a second shape when wiping the printhead. The second shape is different from the first shape through flexure of the blade along both the length and the width of the blade. According to a further aspect of the present invention, an inkjet printing mechanism is provided including a wiping system, which may be as described above.

According to an additional aspect of the present invention, a method of cleaning an inkjet printhead of an inkjet printing mechanism is provided. The method includes the steps of providing a wiper blade having a width and a length, with the blade having a first shape when relaxed. In a wiping step, the printhead is wiped through relative motion of the wiper blade and the printhead. During the wiping step, in a flexing step, the blade is flexed along both the length and the width of the blade into a second shape which is different from the first shape.

An overall goal of the present invention is to provide a printhead service station for an inkjet printing mechanism that facilitates printing of sharp vivid images, particularly when using fast drying pigment based, co-precipitating, or dye based inks by providing fast and efficient printhead servicing.

A further goal of the present invention is to provide a method of cleaning an inkjet printhead that is expediently accomplished in an efficient manner without unnecessarily damaging or wearing the printhead, especially near the ink-ejecting nozzle orifices.

Another goal of the present invention is to provide a wiping system for cleaning inkjet printheads which is easy to manufacture, leading to lower manufacturing costs and a more economical printing unit for consumers.

BRIEF DESCRIPTION OF THE DRAWINGS

FIG. 3 is an enlarged, perspective view of one form of one of the wiper blades in the service station of FIG. 2.

FIG. 4 is a top plan view of the wiper blade of FIG. 3, with the cross sectional shape of the earlier rectangular wiper blade being shown in dashed lines for comparison.

DETAILED DESCRIPTION OF THE PREFERRED EMBODIMENTS

Figure 1:
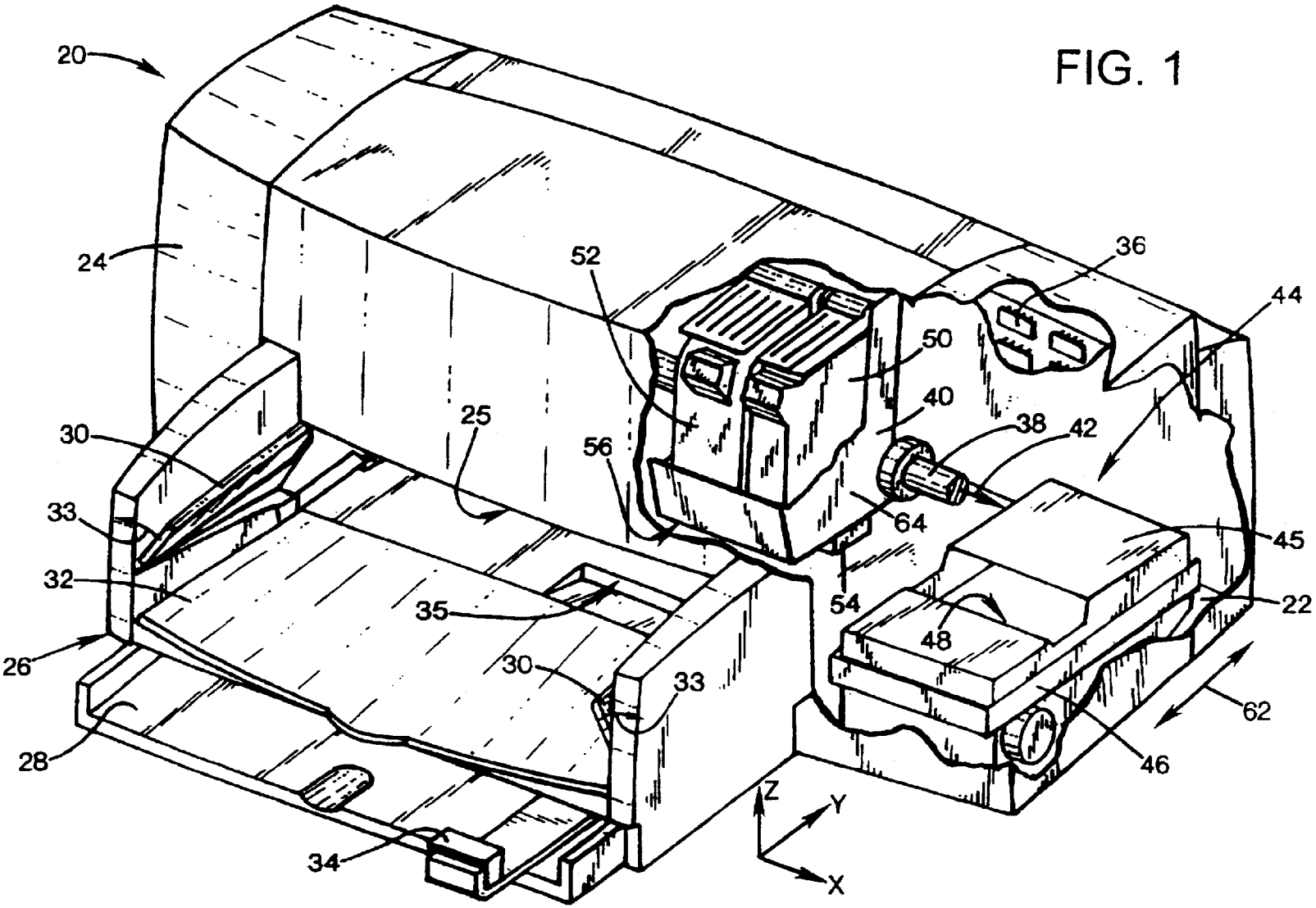
FIG. 1 is a fragmented, partially schematic, perspective view of one form of an inkjet printing mechanism including a servicing station of the present invention which has wiper blades with a contoured cross sectional shape.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing or casing enclosure 24, typically of a plastic material. Sheets of print media are fed through a printzone 25 by an adaptive print media handling system 26, constructed in accordance with the present invention. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional motor-driven paper drive rollers (not shown) may be used to move the print media from tray 28 into the printzone 25 for printing. After printing, the sheet then lands on a pair of retractable output drying wing members 30, shown extended to receive a printed sheet. The wings 30 momentarily hold the newly printed sheet above any previously printed sheets still drying in an output tray portion 32 before pivotally retracting to the sides, as shown by curved arrows 33, to drop the newly printed sheet into the output tray 32. The media handling system 26 may include a series of adjustment mechanisms for accommodating different sizes of print media, including letter, legal, A-4, envelopes, etc., such as a sliding length adjustment lever 34, and an envelope feed slot 35.

The printer 20 also has a printer controller, illustrated schematically as a microprocessor 36, that receives instructions from a host device, typically a computer, such as a personal computer (not shown). Indeed, many of the printer controller functions may be performed by the host computer, by the electronics on board the printer, or by interactions therebetween. As used herein, the term "printer controller 36" encompasses these functions, whether performed by the host computer, the printer, an intermediary device therebetween, or by a combined interaction of such elements. The printer controller 36 may also operate in response to user inputs provided through a key pad (not shown) located on the exterior of the casing 24. A monitor coupled to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 38 is mounted to the chassis 22 to slideably support a reciprocating inkjet carriage 40, which travels back and forth across the printzone 25 along a scanning axis 42 defined by the guide rod 38. One suitable type of carriage support system is shown in U.S. Pat. No. 5,366,305, assigned to Hewlett-Packard Company, the assignee of the present invention. A conventional carriage propulsion system may be used to drive carriage 40, including a position feedback system, which communicates carriage position signals to the controller 36. For instance, a carriage drive gear and DC motor assembly may be coupled to drive an endless belt secured in a conventional manner to the pen carriage 40, with the motor operating in response to control signals received from the printer controller 36. To provide carriage positional feedback information to printer controller 36, an optical encoder reader may be mounted to carriage 40 to read an encoder strip extending along the path of carriage travel.

The carriage 40 is also propelled along guide rod 38 into a servicing region, as indicated generally by arrow 44, located within the interior of the casing 24. The servicing region 44 houses a service station 45, which may provide various conventional printhead servicing functions. For example, a service station frame 46 holds a group of printhead servicing appliances, described in greater detail below. In FIG. 1, a spittoon portion 48 of the service station is shown as being defined, at least in part, by the service station frame 46.

In the printzone 25, the media sheet receives ink from an inkjet cartridge, such as a black ink cartridge 50 and/or a color ink cartridge 52. The cartridges 50 and 52 are also often called "pens" by those in the art. The illustrated color pen 52 is a tri-color pen, although in some embodiments, a set of discrete monochrome pens may be used. While the color pen 52 may contain a pigment based ink, for the purposes of illustration, pen 52 is described as containing three dye based ink colors, such as cyan, yellow and magenta. The black ink pen 50 is illustrated herein as containing a pigment based ink. It is apparent that other types of inks may also be used in pens 50, 52, such as thermoplastic, wax or paraffin based inks, as well as hybrid or composite inks having both dye and pigment characteristics.

The illustrated pens 50, 52 each include reservoirs for storing a supply of ink. The pens 50, 52 have printheads 54, 56 respectively, each of which have an orifice plate with a plurality of nozzles formed therethrough in a manner well known to those skilled in the art. The illustrated printheads 54, 56 are thermal inkjet printheads, although other types of printheads may be used, such as piezoelectric printheads. Indeed, the printheads 54 and 56 may be constructed as illustrated by printhead P in the prior art drawing of FIG. 8, including nozzles N and a pair of encapsulant beads E, as described in the Background Section above; however, it is apparent that other printheads may be constructed without encapsulant beads. These printheads 54, 56 typically include a substrate layer having a plurality of resistors which are associated with the nozzles. Upon energizing a selected resistor, a bubble of gas is formed to eject a droplet of ink from the nozzle and onto media in the printzone 25. The printhead resistors are selectively energized in response to enabling or firing command control signals, which may be delivered by a conventional multi-conductor strip (not shown) from the controller 36 to the printhead carriage 40, and through conventional interconnects between the carriage and pens 50, 52 to the printheads 54, 56.

Preferably, the outer surface of the orifice plates of printheads 54, 56 lie in a common printhead plane. This printhead plane may be used as a reference plane for establishing a desired media-to-printhead spacing, which is one important component of print quality. Furthermore, this printhead plane may also serve as a servicing reference plane, to which the various appliances of the service station 45 may be adjusted for optimum pen servicing. Proper pen servicing not only enhances print quality, but also prolongs pen life by maintaining the health of the printheads 54 and 56.

To provide higher resolution hardcopy printed images, recent advances in printhead technology have focused on increasing the nozzle density, with levels now being on the order of 300 nozzles per printhead, aligned in two 150-nozzle linear arrays for the black pen 50, and 432 nozzles for the color pen 52, arranged in six 72-nozzle arrays with two arrays for each color. These increases in nozzle density, present limitations in printhead silicon size, pen-to-paper spacing considerations, and media handling requirements have all constrained the amount of room on the orifice plate. While the printhead and flex circuit may be conventional in nature, the increased nozzle density requires optimization of wiping performance, including wiping over uneven surface irregularities. For example, the printhead nozzle surface is bounded on each end by two end beads of an encapsulant material, such as bead E of an epoxy or plastic material, which covers the connection between a conventional flex circuit and the printhead housing the ink firing chambers and nozzles. Other printhead constructions may not require encapsulant beads, but instead may have other surface irregularities which may cause wiping difficulties when using the earlier cantilevered wipers or the spring-loaded wipers described in the Background Section above.

Figure 2:
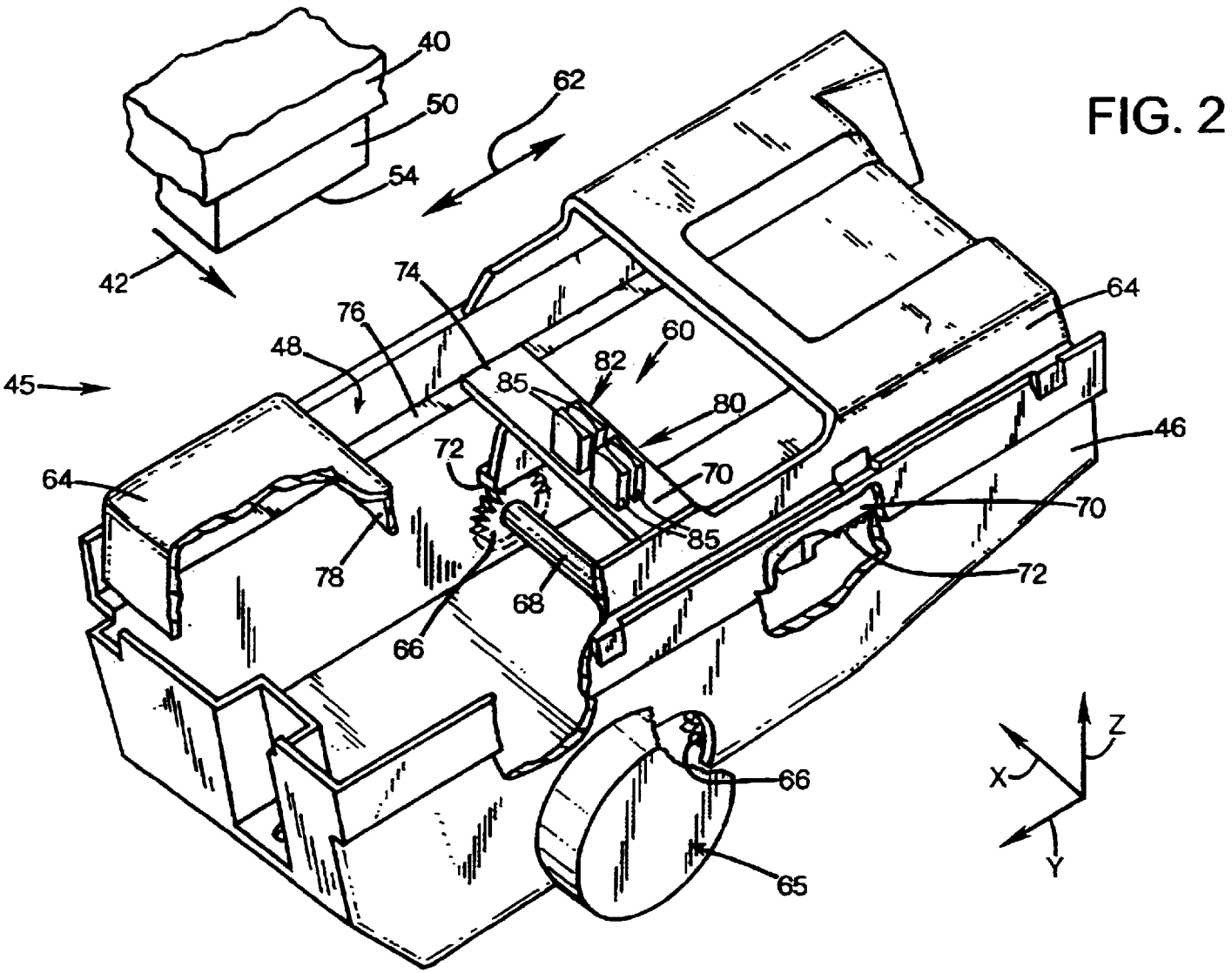
FIG. 2 is an enlarged, fragmented, perspective view of one form of a service station of FIG. 1.

FIG. 2 shows one embodiment of a contoured, cross sectionally shaped wiper blade printhead cleaning system 60, constructed in accordance with the present invention, and installed in the translational service station 45. The service station 45 facilitates orthogonal printhead wiping strokes, that is, wiping along the length of the linear nozzle arrays of the printheads 54 and 56, as indicated by arrow 62, which is perpendicular to the scan axis 42. The service station 45 includes an upper frame portion or bonnet 64 which is attached to the frame base 46. The exterior of the frame base 46 supports a conventional service station drive motor and gear assembly 65, which may include a stepper motor or a DC (direct current) motor, that is coupled to drive one of a pair of drive gears 66 of a spindle pinion drive gear assembly 68. The spindle gear 68 drives a translationally movable wiper support platform, pallet or sled 70 in the directions indicated by arrow 62 for printhead servicing. The pallet 62 may carry other servicing components, such as a pair of conventional caps (not shown) for sealing the printheads during periods of inactivity. The pair of spindle gears 66 each engage respective gears of a pair of rack gears 72 formed along a lower surface of pallet 70. The pallet 70 has sliding supports 74 that ride in tracks 76 defined along the interior surfaces of the frame base 46 and/or bonnet 64 for translational movement toward the front and rear of the printer 20, as indicated by arrow 62. A wiper scraper bar 78 extends downwardly from the bonnet 64.

The new wiping system 60 includes a black wiping assembly 80 for wiping the black printhead 54, and a color wiping assembly 82 for wiping the color printhead 56. By constructing the wiper assemblies 80, 82 as symmetrical pairs of wiper blades, bi-directional wiping strokes may be used to scrub and clean printheads 54, 56, with the leading blade first contacting the orifice plate and the trailing blade following the leading blade. In the illustrated embodiment, both the black and color wiping assemblies 80, 82 are constructed identically, although it is apparent to those skilled art that in some implementations it may be preferable to provide the black wiping assembly 80 with ink residue escape recesses, such as taught in U.S. Pat. No. 5,614,930, assigned to the Hewlett-Packard Company. Moreover, while the wiper blades are illustrated as having wiping tips with square edges, the wiping edges may be formed with rounded outboard ink-wicking edges and angular interior cleaning edges, as taught in U.S. Pat. No. 5,614,930.

FIG. 3 illustrates a contoured cross section wiper blade 85 of the black wiper assembly 80 in greater detail as representative of the wiper blades used to construct the black and color wiper assemblies 80 and 82. While a pair of wiper blades is illustrated for cleaning each printhead 54, 56, it is apparent that in some implementations, a single wiper blade may be used to clean both printheads if the inks are compatible, or alternatively, two wiper blades may be supplied, one for each printhead 54, 56. In FIG. 3 we see the black wiper blade 85 projecting upwardly from the service station pallet or sled 70. The wiper blade 85 has two opposing exterior surfaces 86 and 88, which terminate in a wiping tip 90 with one wiping edge 92 along the surface 86, and another wiping edge 94 along the opposite surface 88. Preferably, the wiper blades 85 are constructed from a flexible material, which may be any conventional wiper material known to those skilled in the art, but preferably, they are of a resilient, non-abrasive, elastomeric material, such as nitrile rubber, or more preferably, ethylene polypropylene diene monomer (EPDM). The wiper blades 85 may be attached to the pallet 70 in a variety of different manners known to those skilled in the art, such as by bonding, by onsert molding, or by onsert molding the blades to a separate wiper mounting member, such as a stainless steel clip which is then snapped into place on the pallet 70.

FIG. 4 shows the wiper blade 85 beginning to wipe printhead 54 in the direction of arrow 62'. For discussion purposes, superimposed over blade 85 is a dashed line representation of an earlier prior art rectangular wiper blade 95, having a leading wiping edge 96 and a trailing wiping edge 98. The printhead 54 is illustrated as having a nozzle region 100, which extends along the length of a first array of nozzles 102, and along the length of a second array of nozzles 104, with the nozzle region 100 having a width of dimension WN. The width of the orifice plate of printhead 54 is illustrated as dimension WO. Other dimensions shown in FIG. 4 include the width of the wiper blades 85 and 95 as dimension WB; the thickness of the prior art wiper blade 95 as dimension T1, which also corresponds to the minimum width of the contoured wiper blade 85; and the maximum dimension of the contoured blade 85 which is shown as dimension T2. The difference between the thickness dimension T2 and the minimum thickness dimension T1 of the contoured blade 85 along the leading wiping edge 92 is shown as dimension H1. The difference between the maximum width T2 and minimum width T1 along the trailing edge 94 of the contoured blade 85 is shown as dimension H2. These dimensions will be useful in discussing the operation and function of the contoured wiper blade 85, particularly when contrasted with the earlier rectangular wiper blade 95.

Figure 5:
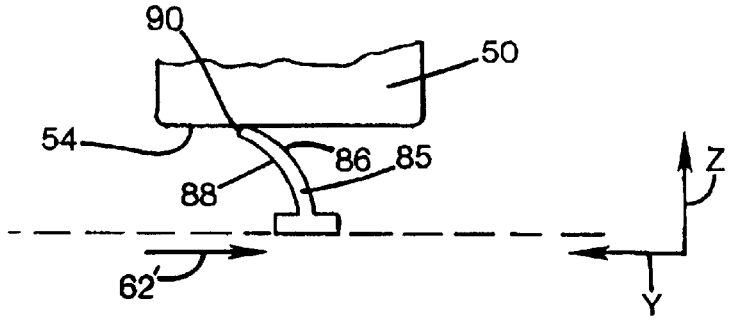
FIG. 5 is an enlarged, side elevational view of the wiper blade of FIG. 3 shown during a wiping stroke.
Figure 6:
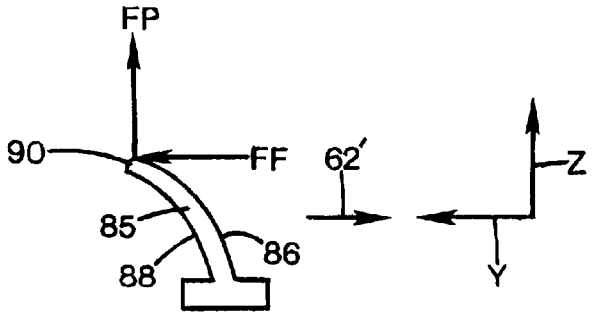
FIG. 6 is a diagram of the wiping forces occasioned by a wiper blade during a wiping stroke, with the perpendicular force applied to the printhead being indicated as FP, and the frictional or drag force applied to the blade being indicated as FF.

FIGS. 5 and 6 illustrate the forces encountered by a wiper blade, such as the contoured blade 85, as well as the earlier rectangular blade 95 during a wiping stroke, as shown in FIG. 5. As the blade 85 slides along the orifice plate of printhead 54, the elastomeric nature of the blade causes it to bend to conform with the pen face, as shown in FIG. 5 when the wiper 85 traverses in direction 62'. As the wiper blade bends during a wiping stroke, the resultant force is distributed over a relatively small area of contact on the pen face, with this contact force having a perpendicular force component FP which is perpendicular to the orifice plate, and a drag or frictional force FF oriented at 90° to the perpendicular force FP.

Figure 7:
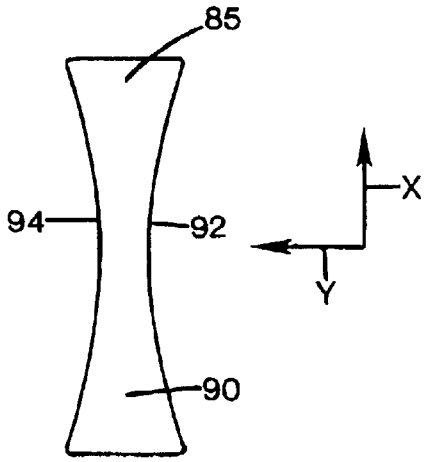
FIGS. 7 and 8 are top plan views of the wiper blade of FIG. 3, shown to compare the relaxed, non-wiping cross sectional shape of the blade in FIG. 7, with the stressed and bowed cross sectional shape of the blade in FIG. 8 during a wiping stroke toward the right in the figure.
Figure 8:
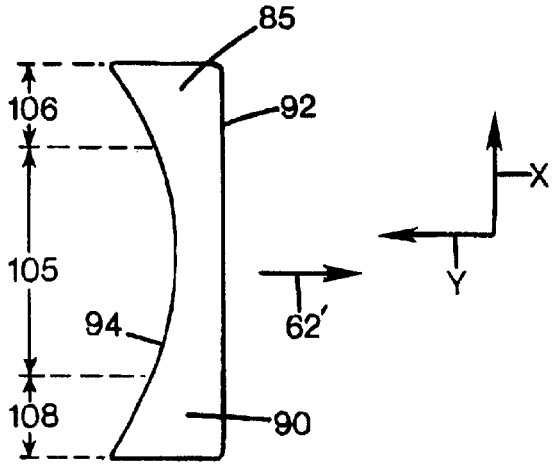

Besides the cantilever forces experienced by the wiper blade 85 as it bends during a wiping stroke, as shown in FIGS. 5 and 6, the wiper blade 85 undergoes another flexing force to maintain contact with the pen face during the wiping stroke. This other force is illustrated through a comparison of FIGS. 7 and 8, with FIG. 7 showing the contoured blade 85 in a relaxed state, and FIG. 8 showing the blade 85 during a wiping stroke in the direction of arrow 62'. In the stressed state of FIG. 8, the concave contour of the leading wiping edge 92 is now straight to maintain contact with the orifice plate across the width of the wiper blade WB. However, it is apparent that to impart the contour of FIG. 8 to blade 85, less force is applied to the printhead along a central nozzle region 105 of the blade 85 than along the lateral edges of the wiper blade at regions 106 and 108 because there is less material at the central region 105 (dimensions T2 are greater than dimension T1, as shown in FIG. 4).

Following printhead wiping, the wiper assemblies 80, 82 are moved toward the front of the printer, in the positive Y-axis direction, where they encounter the wiper scraper bar 78, shown in FIG. 2. The scraper bar 78 extends downwardly into the path of travel of the wiper assemblies 80, 82, so by moving the sled 70 under the scraper bar 78, and then back into the printhead wiping zone, the scraper bar 78 removes ink residue from both the forward facing and rearward facing surfaces of each blade 85.

Figure 9:
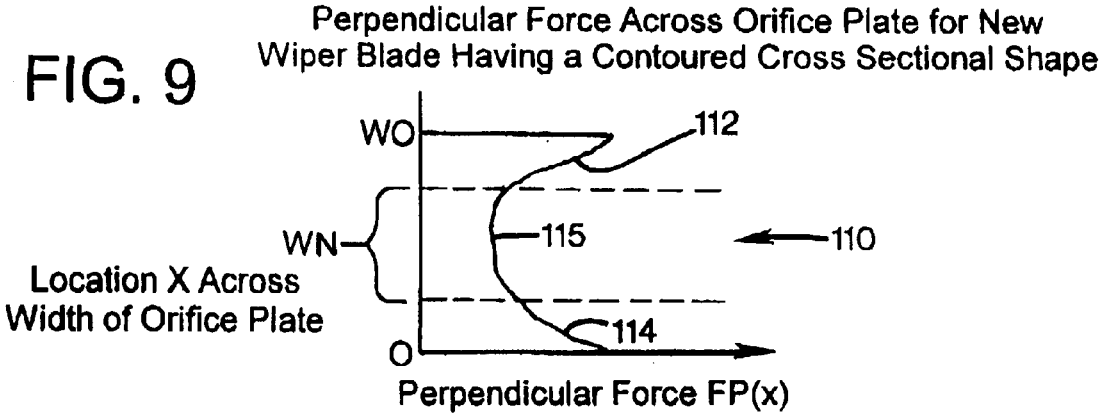
FIG. 9 is a graph of the perpendicular force, FP(X), applied across the entire width X of a printhead orifice plate WO when wiping with the new wiper blade of FIG. 3, with the force experienced by nozzle orifice openings being indicated at WN.
Figure 10:
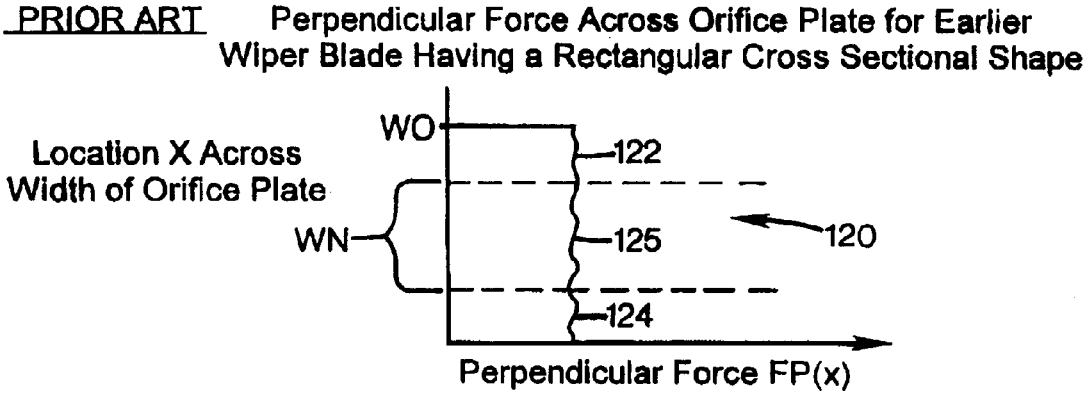
FIG. 10 PRIOR ART
FIG. 10 is a graph of the relatively constant level of perpendicular force, FP(X), applied across the entire width X of a printhead orifice plate WO when wiping with a prior art wiper blade having a rectangular cross sectional shape, with the force experienced by nozzle orifice openings being indicated at WN, as discussed in the Background Section above.

FIG. 9 is a graph of curve 110 showing the perpendicular force across the width of the orifice plate WO of printhead 54 as it is wiped by blade 85. Here, we see graph 110 has high forces 112, 114 along the lateral edges of the printhead beyond the nozzle region 100, and a lower level of force 115 across the width WN of the nozzle region 100. The force graph of FIG. 9 is preferable to that of the prior art rectangular wiper blade 95, which is illustrated by graph 120 in FIG. 10. The force graph 120 is relatively constant in magnitude as indicated at portions 122 and 124 which correspond to wiping across both lateral portions 122 and 124 of printhead 54, as well as at a central portion 125 of the curve which corresponds to wiping across the nozzle region 100 of printhead 54. From a comparison of FIGS. 9 and 10, it can be seen that the force outside the nozzle zone WN is larger where a higher force is desired to better clean off debris and splattered ink using the contoured wiper blade 85, while the relative magnitude of the force 115 in the nozzle region WN is less than the magnitude of the force 125 for the earlier, rectangular wiper blade (FIG. 10) so the potential for nozzle damage is decreased.

Figure 11:
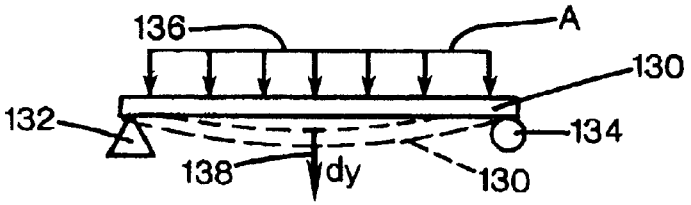
FIG. 11 is a schematic view of a standard beam flexing under a distributed load.

In designing a wiping system using the contoured blade 85, several design factors need to be balanced. Referring to FIG. 11, some of the key design attributes to be characterized and controlled may be better understood by considering a standard beam 130 supported at each end by supports 132 and 134. Here the beam supports a distributed force A, indicated by the group of arrows 136 pointed downwardly along the upper surface of beam 130. Under the distributed load A, the beam 130 flexes downwardly, with the downward deflection being illustrated in dashed lines in FIG. 11 and by arrow 138, which is also labeled as dy. Using a standard equation for the deflection of the beam center, the desired deflection dy may be determined according to the following equation:

$$dy=K(AL^4)\div(EI_X)$$

where:

E is a material constant of the wiper blade;

L is a design constraint equal to the blade width dimension WB in FIG. 4, that is, L=WB;

A is a function of the wiper interference in the Z direction between the blade tip 90 and the printhead orifice plate 54; and $I_X$ is a geometric property and is a function of X, the location along the width of the wiper blade WB, which correlates to the location of interest along the deflected beam 130 between supports 123 and 134.

Given this equation, the primary geometric parameters to adjust to attain the desired wiping forces FF and FP are those illustrated in FIG. 4, in particular: the minimum blade thickness T1; the maximum blade thickness T2; the blade width WB; the degree of curvature or concavity of the leading edge 92, illustrated with respect to dimension H1; the degree of curvature or concavity of the trailing wiping edge 94, illustrated with respect to dimension H2; and the height of the curvature relative to the entire length of the blade, such as if the base of the blade had a rectangular structure which transitioned into the illustrated curvature. For instance, larger wiping forces along the lateral regions of the printhead than along the nozzle region 100, may be achieved by making dimension T2 larger while holding the minimum dimension T1 constant, by decreasing the minimum dimension T1 while holding the maximum dimension T2 constant, or by making dimension T1 larger and dimension T2 smaller.

It is apparent that in some embodiments it may be preferable to have different wiping forces when wiping in a first direction 62', than when wiping in the opposite direction, which may be achieved by changing the relative concavities of the wiping edges 92 and 94. For instance, it may be desirable to wipe harder along the orifice plate with a first wiping stroke, followed by a lighter wiping with edge 94 in the nozzle region. Such a wiping system may be accomplished by providing wiping surface 86 with more concavity than surface 88 (that is, by making dimension H1 greater than dimension H2). Additionally, in some implementations it may be desirable to only contour a portion of the length of the wiper blade, for instance, by having the blade base adjacent to the sled be rectangular and then tapering into the concave wiping surfaces 86, 88. Furthermore, while the illustrated contoured wiper blade 85 is shown as having both leading and trailing surfaces 86, 88 as concave in some implementations it may be desirable to provide only one of these surfaces with concavity, leaving the other one generally rectangular, for instance, using the general shape of the blade shown in FIG. 8 if the blade was in a relaxed state rather than in a unstressed state. It is apparent that other manners of contouring the wiper blade 85 may be employed to impart different wiping forces across the width of the orifice plate 54.

Advantages

Thus, a variety of advantages are realized using the contoured wiper blade 85 over the earlier rectangular cross-section wiper blade 95. Use of the contoured wiper blade 85 provides for adjusting the wiping forces applied across the width of the orifice plate, allowing for a heavier wiping force to be applied in the lateral regions of the printhead (graph regions 112 and 114 in FIG. 9) to provide greater wiping forces for removing debris and splattered ink, with a lower wiping force 115 (FIG. 9) being encountered along the width WN of the nozzle region 100. The contoured wiping blade 85 also has advantages over the proposed solutions of merely thinning the wiper blade or lengthening the wiper blade, discussed in the Background section above. The contoured wiper blade 85 may be easily molded, since additional elastomeric material is added to the blade to increase the width at the lateral edges, and without requiring any lengthening of the blade. Thus, since the contoured wiper blades 85 are easier to mold and manufacture, there will be a lower scrap-out rate than for designs which either thin or lengthen the wiper blade, leaving regions of the mold cavity difficult to fill. Having a lower scrap-out rate allows wiper blade 85 to have a lower piece price, resulting in a more economical finished printer 20 for consumers.

Additionally, by decreasing the wiping force across the nozzle region 100, printhead wear is decreased in the critical nozzle region, promoting longer printhead life, which is particularly important as designs shift to permanent and semipermanent printheads. Furthermore, by lowering the wiping force 115 along the nozzle region 100 the chances of damaging the printhead 54 in the critical nozzle region 100 is also decreased, resulting in truer drop trajectories and better placement of the ink droplets at their desired location on the print sheet, resulting in clearer, sharper images.

There are other advantages associated with using the new contoured, cross-sectionally shaped wiper blade printhead cleaning system 60. By using a dual symmetrical blade design for wiper assemblies 80 and 82, bi-directional wiping may be accomplished by moving the pallet 70 back and forth in the direction of arrow 62 under the printheads 54, 56. While the new contoured blade printhead cleaning system 60 has been illustrated as being supported by a sled which moves between a rest position and a printhead wiping position, as well as a wiper scraping position, it is apparent that wiping through relative motion of the printheads 54, 56 and the wipers 80, 82 may be accomplished in a variety of different manners known to those skilled in the art. For example, a contoured wiper blade may be held by the sled in a stationary position, rotated 90° from the orientation pictured in the drawings, and located in the path traversed by the printhead when entering and exiting the service station region 45. In such a system, wiping is accomplished by moving the printhead back and forth across the wiper, particularly when only a single printhead is used or when the inks of multiple printheads are compatible for wiping with a single wiper. Other ramped, rotary and translational sleds are known for selectively elevating the wipers between rest and wiping positions for cleaning one or more printheads through printhead motion. Other sled systems are known for moving the wipers while holding the printheads stationary to accomplish wiping, such as the rotary orthogonal wiping system discussed in the Background Section above.

Indeed, the contoured blade printhead cleaning system 60 may be used in a page-wide array inkjet printing mechanism having a printhead which partially or completely spans across the entire printzone 25, eliminating the need for a reciprocating carriage 40 to carry the printhead back and forth across the printzone. In such a page-wide array printer, the contoured blade or blades may be moved by a sled across the printhead array, or the page-wide printhead array may be swept across the wiper blade or blades to achieve the relative wiping motion. It is apparent that in a page-wide array printer the printhead servicing region may be considered to be located along the printzone 25, rather than to the side of the printzone, as illustrated for the reciprocating carriage printer 20.

I claim:

1. A wiping system for cleaning an inkjet printhead of an inkjet printing mechanism having a chassis, comprising:

a sled supported by the chassis; and a wiper blade supported by the sled to engage and wipe the printhead through relative motion of the blade and the printhead in a wiping direction, with the wiper blade having a leading surface, which encounters the printhead when wiping in the wiping direction, and a trailing surface opposing the leading surface, with the leading surface having a width with a first contour when relaxed and a second contour different from the first contour when wiping the printhead, and the trailing surface having a third contour different than the first contour with respect to the print head.

2. A wiping system according to claim 1, wherein the second contour is substantially a straight line.

3. A wiping system according to claim 2, wherein the first contour is substantially a concave line with respect to the printhead prior to wiping the printhead.

4. A wiping system for cleaning an inkjet printhead of an inkjet printing mechanism having a chassis, comprising:

a sled supported by the chassis; and a wiper blade supported by the sled to engage and wipe the printhead through relative motion of the blade and the printhead in a wiping direction, with the wiper blade having a leading surface that defines a width and a length, with the leading surface of the blade having a first shape when relaxed and a second shape when wiping the printhead, with the second shape being different from the first shape through flexure of the blade along both the length and the width of the blade, and the blade further including a trailing surface opposite the leading surface, the trailing surface defining a third shape different than the first shape with respect to the print head.

5. A wiping system according to claim 4 wherein at least one of the leading surface and the trailing surface has a concave contour.

6. A wiping system according to claim 4, wherein the second shape is substantially a straight line.

7. A wiping system according to claim 6, wherein the first shape is substantially a concave line with respect to the printhead, prior to wiping the printhead.

8. A method of cleaning an inkjet printhead of an inkjet printing mechanism, comprising the steps of:

providing a wiper blade having a first surface that defines a width and a length and a second surface opposite the first surface, with the first surface of the blade having a first shape when relaxed and the second surface having a third shape different than the first shape;

wiping the printhead through relative motion of the wiper blade and the printhead; and during the wiping step, flexing the first surface of the blade along both the length and the width of the blade into a second shape which is different from the first shape with respect to the print head.

9. A method of cleaning an inkjet printhead according to claim 8, wherein the second shape is substantially a straight line.

10. A method of cleaning an inkjet printhead according to claim 9, wherein the first shape is substantially a concave line with respect to the printhead, prior to the wiping step.

11. An inkjet printing mechanism, comprising:

a chassis which defines a printzone and a servicing region;

an inkjet printhead supported by the chassis to print an image in the printzone;

a sled supported by the chassis in the servicing region; and a wiper blade supported by the sled to engage and wipe the printhead through relative motion of the blade and the printhead in a wiping direction, with the wiper blade having a leading surface, which encounters the printhead when wiping in the wiping direction, and a trailing surface opposing the leading surface, with the leading surface having a width with a first contour when relaxed and a second contour different from the first contour when wiping the printhead, and the trailing surface having a width with a third contour different from the first contour with respect to the print head.

12. An inkjet printing mechanism, comprising:

a chassis which defines a printzone and a servicing region;

an inkjet printhead supported by the chassis to print an image in the printzone;

a sled supported by the chassis in the servicing region; and a wiper blade supported by the sled to engage and wipe the printhead through relative motion of the blade and the printhead in a wiping direction, with the wiper blade having a first surface that defines a width and a length, with the first surface of the blade having a first shape when relaxed and a second shape when wiping the printhead, with the second shape being different from the first shape through flexure of the blade along both the length and the width of the blade, and the wiper blade having a second surface opposite the first surface that defines a third shape different than the first shape with respect to the print head.

13. A wiping system for cleaning an inkjet printhead, comprising:

a sled;

a wiper blade with a leading edge of a first contour, supported by the sled, wherein the wiper blade may engage and wipe the printhead through relative motion of the blade and the printhead;

wherein the first contour deforms into a second contour when the leading edge of the wiper blade is engaging the printhead;

wherein the wiper blade has a trailing edge, opposite the leading edge, with a third contour, the trailing edge never contacting the printhead when the leading edge is engaging the printhead; and wherein the third contour is different than the first contour with respect to the printhead.

14. A wiping system according to claim 13 wherein the second contour is substantially a straight line.

15. A wiping system according to claim 14 wherein the first contour is substantially a concave line with respect to the printhead, prior to wiping the printhead.

16. A wiping system according to claim 13, wherein the second contour is a substantially straight line.

17. A wiping system according to claim 16, wherein the first contour is substantially a concave line with respect to the printhead, prior to wiping the printhead.

18. A wiping system according to claim 17, wherein the third contour is substantially a convex line with respect to the printhead, prior to wiping the printhead.

* * * * *